US007028525B1

(12) United States Patent
Troive et al.

(10) Patent No.: US 7,028,525 B1
(45) Date of Patent: Apr. 18, 2006

(54) METHOD AND A DEVICE FOR DEFORMATION OF A MATERIAL BODY

(75) Inventors: Lars Troive, Falun (SE); Yngve Bergström, Gustafs (SE)

(73) Assignee: Hydropulsor AB, Karlskoga (SE)

( * ) Notice: Subject to any disclaimer, the term of this patent is extended or adjusted under 35 U.S.C. 154(b) by 0 days.

(21) Appl. No.: 09/856,223

(22) PCT Filed: Nov. 19, 1999

(86) PCT No.: PCT/SE99/02127

§ 371 (c)(1),
(2), (4) Date: Sep. 24, 2001

(87) PCT Pub. No.: WO00/30788

PCT Pub. Date: Jun. 2, 2000

(30) Foreign Application Priority Data

Nov. 19, 1998 (SE) ..... 9803956

(51) Int. Cl.
*B21J 5/00* (2006.01)

(52) U.S. Cl. ..... 72/377; 264/120; 425/78

(58) Field of Classification Search ..... 72/437, 72/438, 435, 443, 453.02, 377, 407; 264/120; 425/78

See application file for complete search history.

(56) References Cited

U.S. PATENT DOCUMENTS 2,382,045 A * 8/1945 Flowers ..... 72/377
3,115,676 A * 12/1963 Quartullo ..... 425/78
3,187,548 A * 6/1965 Murek ..... 72/435
3,818,799 A * 6/1974 Hague ..... 91/40
3,898,834 A * 8/1975 Kramer ..... 72/453.13
4,131,164 A * 12/1978 Hague et al. ..... 173/1
4,178,792 A * 12/1979 Matviets et al. ..... 72/436
4,226,111 A * 10/1980 Wahli ..... 72/437
6,711,928 B1 * 3/2004 Easterbrook ..... 72/334

FOREIGN PATENT DOCUMENTS

| | | |
|---|---|---|
| DE | 2338221 | 2/1975 |
| EP | 0022433 | 1/1981 |
| WO | WO97/00751 | 1/1997 |
| WO | WO 9700751 A * | 1/1997 |

OTHER PUBLICATIONS

Derwent's Abstract No. 48412 B/26K. week 7926. Abstract of SU 621434. Jul. 24, 1978.

* cited by examiner

*Primary Examiner*—Lowell A. Larson
(74) *Attorney, Agent, or Firm*—Dilworth & Barrese LLP.

(57) ABSTRACT

The device comprises a stamping member (2) arranged to be conveyed towards and hit a material body (1) with such a velocity that a rebound motion of the stamping member (2) is generated while a permanent deformation of the material body (1) is generated. The device has structure (3) for counteracting the rebound and generating at least one additional impact of the stamping member (2) against the material body (1) within a period, during which kinetic energy in the material body (1) generates an additional deformation in the body.

17 Claims, 4 Drawing Sheets

METHOD AND A DEVICE FOR DEFORMATION OF A MATERIAL BODY

BACKGROUND OF THE INVENTION AND PRIOR ART

The present invention is related to a method for deformation of a material body, in which a stamping member with a mass m is conveyed towards and hits a material body with such a velocity that at least one rebound motion of the stamping member is generated, while a permanent deformation of the body is generated. The invention also relates to a device for deformation of a material body, comprising a stamping member arranged to be conveyed towards and hit a material body with such a velocity that a rebound motion of the stamping member is generated, while a permanent deformation of the material body is generated.

Through the earlier patent application No. WO 97/00751 of the applicant it is known to fix a material body, either in solid form or in form of a powder of grain, pellets or similar and with one single or several consecutive strokes by means of a striking unit achieve adiabatic coalescence in the material body, through which a fast and effective deformation of the material body is obtained.

According to this prior art, when a plurality of consecutive strokes is applied to the body, the interval between the consecutive strokes should be smaller than approximately 0,2 seconds. At compacting of powder, preferably metal powder, it is suggested that three consecutive strokes are applied to the material body. Of these strokes, the first one is an extremely light stroke forcing the most of the air out of the powder and orientating the powder particles. The next stroke has very high energy and high striking velocity in order to achieve local adiabatic coalescence of the powder particles so that these are pressed together to extremely high density. The third stroke has medium high energy, i.e. lower energy than the second stroke, and achieves final shaping of the material body, which subsequently can be sintered. At corresponding deformation of a solid metal body, sliding planes will be activated during a large local temperature increase in the material, through which the required deformation is achieved.

In both the described cases, however, a very powerful impulse from the striking unit will be required to achieve the intended deformation effect when one single stroke or several strokes at intervals of in the order 200 ms are used to achieve the desired goal. The striking tool, or the stamping member, is allowed to bounce back between every single stroke. It is thereby not in contact with the material body between the strokes, only once per stroke. The stroke or the strokes give a locally very powerful increase of the temperature in the material of the deformed body. When the material of the body comprises one or several metals or metal alloys, such a powerful temperature increase usually results in phase transitions of the material, both when heating it and subsequently cooling it. The cooling can further often be done relatively fast, since the temperature increase often is local and the heat can be carried off via the surrounding, colder material. The probability is high that unwanted structures and phases, for instance martensite in steel, are obtained as a result of this process.

SUMMARY OF THE INVENTION

An object with the present invention is to provide a method, by means of which a deformation of a material body of the initially mentioned kind is performed with as low a temperature increase in the material body as possible while still achieving a satisfactory deformation of the material body. Thereby the method should to a great extent enable the emergence of disadvantageous phases and structures in the material body due to too strong temperature variations in it.

The inventor has at practical experiments discovered that reciprocating waves are generated in the material body at the moment when the stamping member bounces back from the material body. These waves define a kinetic energy in the material body, which energy gradually, in sequences, activates planes in the body and probably also causes mutual displacements of grain of a powder while said waves fast subside. Attempts have been made with material bodies of steel, placed on a base and deformed by means of a stamping member, which has hit these vertically from above. In connection with that it has been noted that the reciprocating waves move forth and back essentially in the impact direction of the stamping member, i.e. from the surface of the material body hit by the stamping member to the surface which abuts against the base and back. At such test material bodies of steel, said waves subside so much that they no longer generate any considerable deformation in the material within a few milliseconds.

The object of the invention has been achieved by means of a method of the initially mentioned kind, which is characterized in that the rebound motion of the stamping member is counteracted, through which at least one additional impact of the stamping member against the material body is generated within a period, during which kinetic energy in the material body generates an additional deformation in the body. The at least one additional impact thereby supplies energy to the material body to such an extent that it contributes to the kinetic energy of the reciprocating wave, through which an additional deformation of the body achieved by said wave continues during a longer period than if not any immediate return impact of the stamping member has been performed. The additional deformation achieved by the wave can comprise only sliding plane activation, and/or mutual displacements of grain in the case of a powder body. The additional impact, having a certain impulse and supplying a certain energy, will, thanks to the additional deformation established by the wave, further plastically deform the body. A substantially smaller impulse is required for a given deformation at this time, when more sliding planes are activated, than would have been the case if the additional impact had been applied at a later occasion, when said wave had already subsided.

The inventor has discovered that a lower total energy needs to be supplied to the material body and that a comparatively low temperature increase in the material body can be achieved while still achieving the desired deformation of the material body by means of the method according to the invention.

According to a preferred embodiment of the method according to the invention, a series of impacts is applied by means of the stamping member against the material body within said period.

Through a series of fast impacts, the material body is continuously supplied kinetic energy which contributes to keeping the reciprocating wave alive and consequently favours further generation of the additional deformation in the material body at the same time as each new impact generates an additional plastic, permanent deformation of the body. The series of impacts is achieved in that a corresponding series of rebounds of the stamping member is counteracted and a new respective impact is achieved, which in its turn generates a new rebound. Every impulse, with which the stamping member hits the material body is consequently large enough to generate a rebound of the stamping member within said series. When several consecutive strokes are applied against the material body for deformation of it, said series of impacts is applied in direct connection with the respective stroke. The stroke defines the first impact in the respective series of impacts.

According to a further preferred embodiment the impulse, with which the stamping member hits the material body, decreases with each impact within said series. When a stroke only comprising two impacts, a first and a second one, is applied against the material body, the first impact has a larger impulse than the second. Thanks to the effect of the wave on the material body, such a large impulse from the second impact is no longer necessary to generate a certain desired additional plastic deformation. Also in practice it becomes easier to achieve a second impact with a smaller impulse than the first impact within such a short period of time here referred to (approximately 1 ms), for instance by effective damping of the rebound motion. The possibility to apply a second impact with a larger impulse than the first or previous impact shall however not be excluded, if required.

According to another preferred embodiment the material body is a solid body comprising a metal material, said deformation comprising a reshaping of the body. The additional deformation is thereby done in that the kinetic energy of the reciprocating wave generates a gradual activation of sliding planes in the material body. Since the sliding planes are activated gradually, a slower and less intense deformation of the material can be achieved by the application of one or several additional impacts besides the first against the material body. The temperature increase in the material body hereby does not need to be as large as when a corresponding deformation of the body shall be achieved by means of one single impact, after which the reciprocating wave in the material body is allowed to subside without any additional energy being supplied hereto from outside.

According to a further preferred embodiment the material body comprises a powder, provided in a mould. The deformation of the powder body comprises a compacting thereof. The method according to the invention offers a fast and effective way of compacting powder, for instance cemented carbide powder, without any unnecessarily high temperatures, which could lead to forming of undesired structures and/or phases being generated in the powder. As mentioned above, the prior art suggests that the powder material body is compacted in three steps, a first step when a light stroke is applied against the body in order to achieve an initial orientation of the powder particles, a second step when a very powerful stroke is directed against the powder to achieve local adiabatic coalescence of the powder particles so that these are pressed together to high density, and a third step, at which a stroke of medium high energy is applied against the powder body and a final forming takes place. The method according to the invention could with advantage be applied at the second step and/or possibly at the third step.

A further object of the invention is to provide a device, by means of which it is possible to work a material body by means of a stamping member hitting the material body with such an impulse that an adiabatic coalescence is obtained in the material body, at which a minimum temperature increase is achieved in the body at the same time as the deformation aimed at is obtained.

This object is obtained by means of a device of the initially defined kind, characterized in that it comprises means for counteracting the rebound and for generating one additional impact of the stamping member against the material body within a period, during which kinetic energy in the material body generates an additional deformation herein.

According to a preferred embodiment, the path of motion of the stamping member towards the material body is such that the body is accelerated under the influence of the gravity force acting on it and the rebound is counteracted by the gravity force. Thereby the own mass of the stamping member can be used for generating the additional impact directed against the body. Preferably the stamping member is allowed to drop substantially vertically in the direction of the material body, through which the gravity force is used maximally to counteract the rebound of the stamping member.

According to a further preferred embodiment, the device comprises means for application of a force $F_1$ to the stamping member, which force acts in the direction towards the material body and counteracts the rebound. By a suitable choice of the mass of the stamping member, the drop and the size of the force $F_1$ applied it is consequently possible to control the time between two consecutive impacts of the stamping member against the material body. The applied force $F_1$ not only counteracts the rebound but also contributes to actively pushing the stamping member in the direction towards the material body.

According to a further preferred embodiment, the device is arranged to perform a series of impacts by means of the stamping member against the material body within said period. Every single impact thereby takes place with such a velocity of the stamping member that a following rebound of it is generated. The device can thereby comprise means for controlling the size of the force applied on the stamping member, for instance so that it gradually subsides with every additional rebound in order to achieve a harmonic and not too fast a damping of the motions of the stamping member against the material body.

According to a further preferred embodiment, the impulse, with which the stamping member hits the material body, decreases with each impact within said series. Above all the difference in impulse between the first impact and the second impact is large. The respective impulses contribute to preventing the reciprocating wave in the material body from subsiding too fast. In this manner energy is supplied in the form of kinetic energy to the material body within a period, during which the kinetic energy in the most effective way generates a deformation in the material body. As mentioned above, the additional deformation generated by the wave in the body comprises activation of sliding planes. Each additional impact within said period benefits therefrom for generating an additional plastic deformation of the material body while said sliding planes are still activated.

Further characteristics and advantages of the invention will be apparent from the following description and from the other patent claims.

BRIEF DESCRIPTION OF THE DRAWINGS

The invention will hereinafter be described for exemplifying purposes with reference to the enclosed drawings, in which.

DETAILED DESCRIPTION OF PREFERRED EMBODIMENTS

Figure 2:
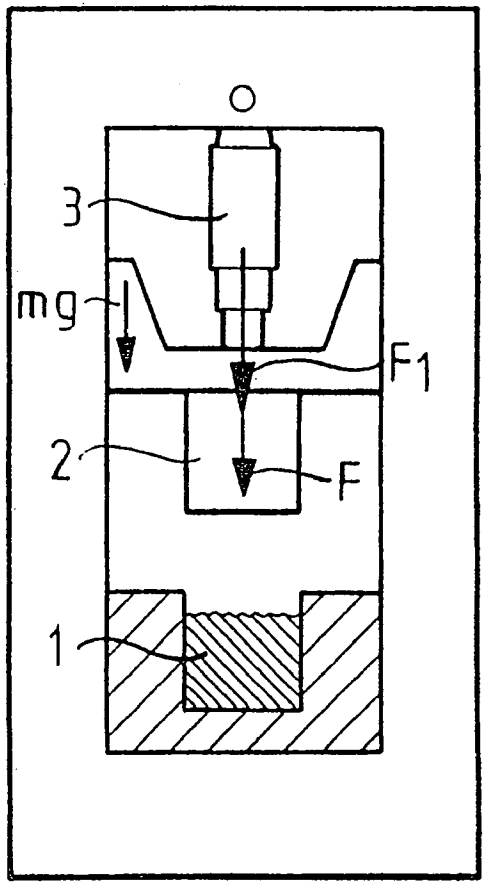
FIG. 2 is a schematic cross-sectional view from the side, showing a similar device for compacting of a powder.
Figure 1:
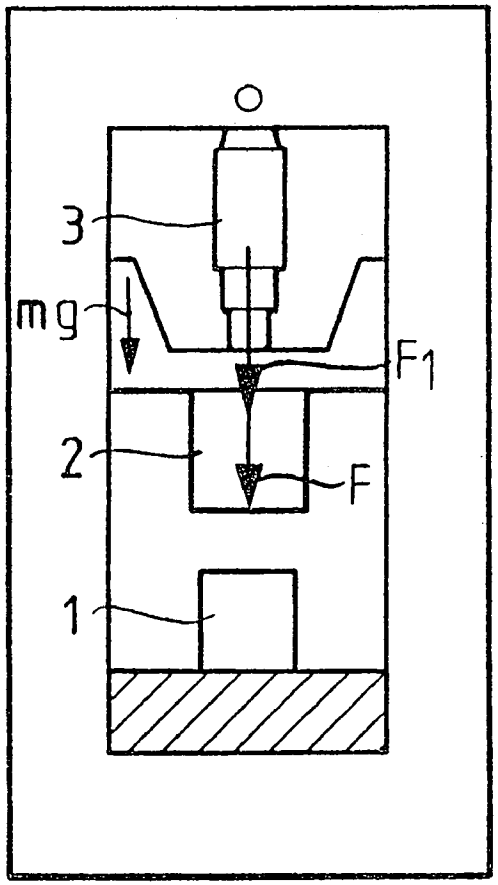
FIG. 1 is a schematic cross-sectional view from the side, showing a device for deformation of a solid body.

In FIGS. 1 and 2 a device for deformation of a material body 1 is shown schematically. The device comprises a stamping member 2, arranged to be conveyed towards and hit the material body 1 with such a velocity that a rebound motion of the stamping member 2 is generated. Thereby the material body 1 is deformed.

The material body in FIG. 1 is formed by a material in solid form, preferably a solid metal. In FIG. 2 the material body 1 is formed by a powder preferably already being lightly compacted, either by means of a light stroke of the stamping member or some other similar member. The device is arranged to achieve an immediate and relatively large deformation of the material body 1 by means of a powerful stroke of the stamping member.

The stamping member 2 is so provided that it under influence of the gravity force acting on it is accelerated towards the material body 1. The mass m of the stamping member 2 is preferably substantially larger than the mass of the material body 1. Thereby the need for a high impact velocity of the stamping member 2 can be reduced somewhat. The stamping member 2 is allowed to hit the material body 1 with such a velocity that a local adiabatic coalescence and a deformation in the material body 1 associated therewith is obtained. The velocity is furthermore such that a rebound of the stamping member 2 is generated. The deformation of the material body 1 thereby achieved is plastic and consequently permanent. When the stamping member 2 rebounds, strong waves or vibrations in the material body 1 is generated in the striking direction of the stamping member 2. The waves are initially amplified when the stamping member 2 is not in immediate contact with the material body 1. This wave or these waves have a high kinetic energy and will activate sliding planes in the material body, which have not been activated during the previous impact. During the period, when these sliding planes are activated, the material body 1 will be relatively easier to deform with a given impulse or energy of a next following impact. The device is therefore so provided that a sufficient force acts on the stamping member 2 in the direction towards the material body 1 because an additional impact, with an impulse exceeding a minimum value, is generated against the material body 1 within said period. The period is however very short, in the order of a few milliseconds. If the mass of the stamping member 2 is very large it could in fact be possible to achieve said additional impact within this period by only letting the gravity force act on the stamping member 2 and damp the rebound and accelerate the stamping member 2 against the material body 1.

According to the shown preferred embodiment of the device, the latter however comprises a means 3 for application of a force $F_1$ on the stamping member 2, which force acts in the direction towards the material body 1 and counteracts the rebound. This means 3 can comprise a force cylinder, for instance a hydraulic cylinder. The purpose of it is not only to counteract the rebound motion of the stamping member 2, but also to accelerate the stamping member 2 towards the material body 1 and thereby contribute to the impulse, with which the stamping member 2 hits the material body 1 at the following impact. Preferably the force $F_1$, the moving path of the stamping member 2 and the direction of motion towards the material body 1 and the mass m of the stamping member 2 are adapted so that an additional impact, preferably several additional impacts, each contributing to extend said period and in steps further plastically deform the material body 1 are generated.

Figure 3:
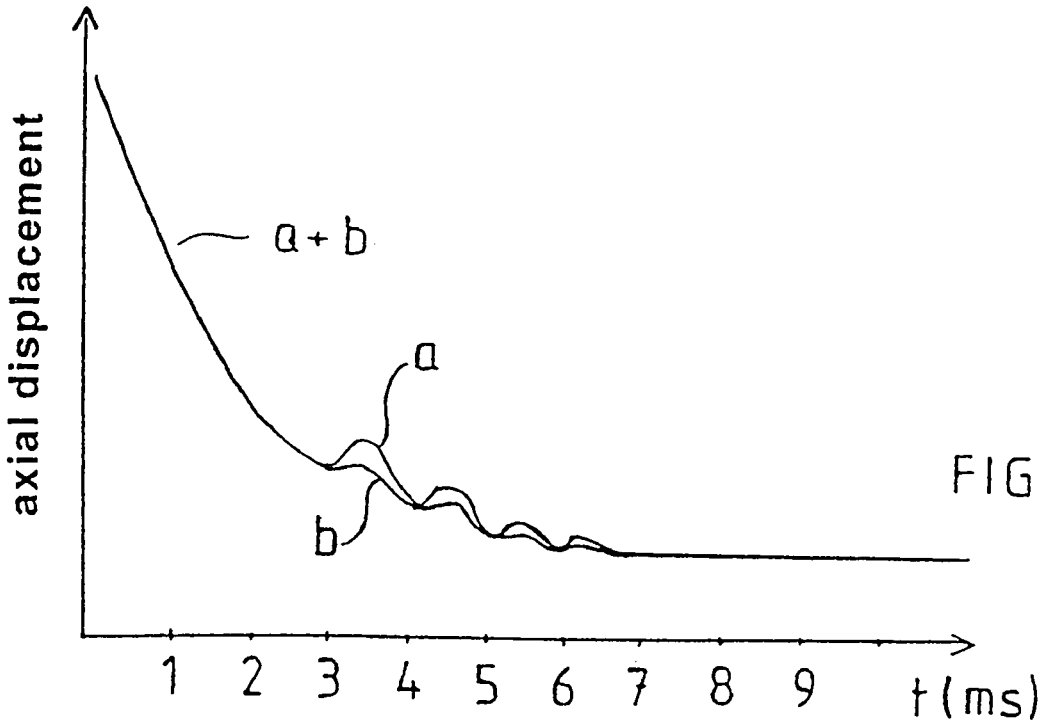
FIG. 3 is a diagram schematically showing a registered displacement of a stamping member according to FIG. 1 or 2 in time.

FIG. 3 schematically shows the axial displacement of the stamping member 2 in time from the moment when the stamping member 2 hits the material body 1 and starts to deform it to the time, when the wave or waves in the material body have subsided and additional possible rebounds and impacts from the stamping member no longer generate any substantial additional deformation of the material body 1. The diagram is created from a test, at which a stamping member 2 with a mass of 105 kg was used for deformating a cylinder with the height 20 mm and the diameter 12 mm, made of soft annealed bearing steel. By means of a hydraulic piston in addition 50 kN was applied to the stamping member 2 in the direction towards the material body 1, i.e. the steel cylinder.

The velocity, with which the stamping member 2 was allowed to hit the material body 1 was varied at different tests. At the test generating a diagram, approximately corresponding to the diagram of FIG. 3, velocities in axial direction of the stamping member 2 was measured and from a calculation model a schematic image over a typical velocity of the material body 1 in axial direction was obtained, which velocities are approximately illustrated in FIG. 4. The line a indicates the velocity of the stamping member and line b indicates the velocity of the material body. It is evident how a wave, i.e. a reciprocating motion, is generated in the material body 1 as soon as the rebound motion of the stamping member 2 has begun. This occurs in the illustrated test after approximately 3 ms. One millisecond later, i.e. after 4 ms, the device performs the next impact.

At the impact moment, when the stamping member 2 and the material body 1 are in contact with each other and the material body 1 is deformed under the influence of the impulse of the stamping member 2, the amplitude of the wave in the material body 1 subsides somewhat, to then increase in size again when the stamping member 2 again bounces back and completely or partly looses contact with the material body 1 for a short moment. The period between two consecutive impacts is in the order of 1 ms. After a certain time, here in the order of 5 ms, the wave in the material body 1 has, however, subsided so much that it no longer contributes to activation of additional sliding planes. Additional impacts from the stamping member 2 will thereby not to any considerable extent contribute to any additional plastic deformation of the material body 1, as long as not any radical measures are taken, for instance a prominent increase of the power, with which the stamping member 2 is influenced. When this stage has been achieved the stamping member can suitably be returned to a position, from which a new, corresponding series of impacts against an additional material body 1 or the same material body 1 is performed.

Figure 4:
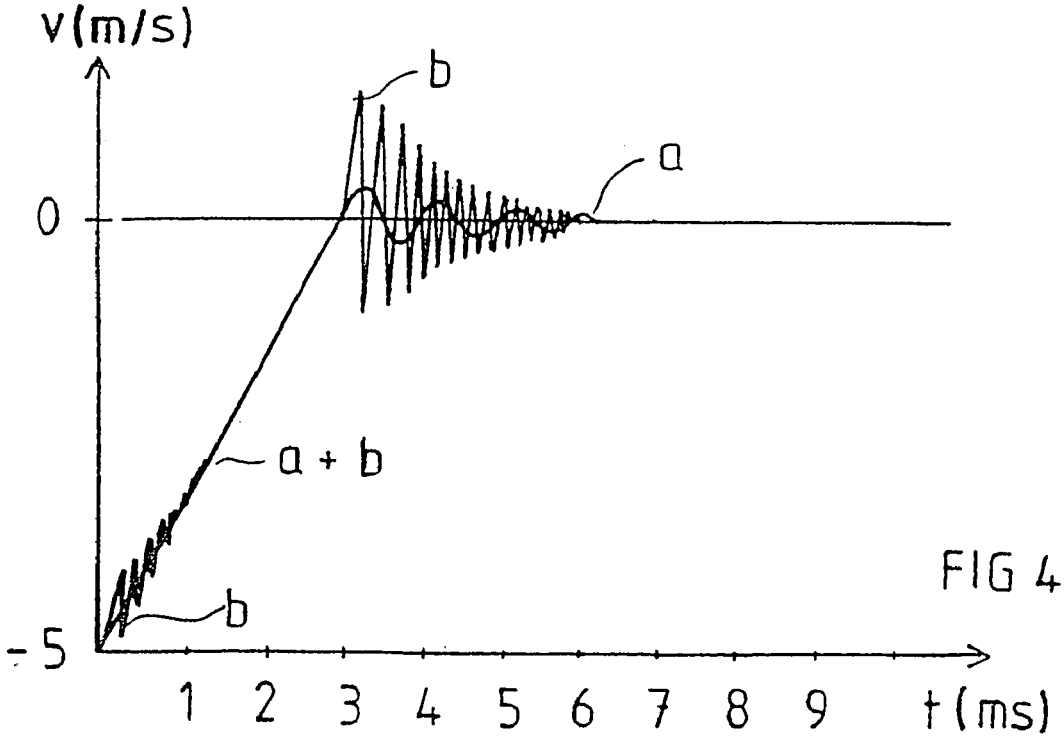
FIG. 4 is a diagram schematically showing the axial velocity of the stamping member and a surface of the material body respectively, according to FIG. 1 in time.

It should be mentioned that a reciprocating wave can appear in the material body 1 also during the initial plastic deformation of it, i.e. before the rebound motion of the stamping member 2 has been generated, but that this wave has a substantially lower amplitude than when the rebound motion has been generated. For the sake of clarity no reciprocating wave of the material body 1 at the initial deformation thereof is shown in FIG. 4.

Figure 5:
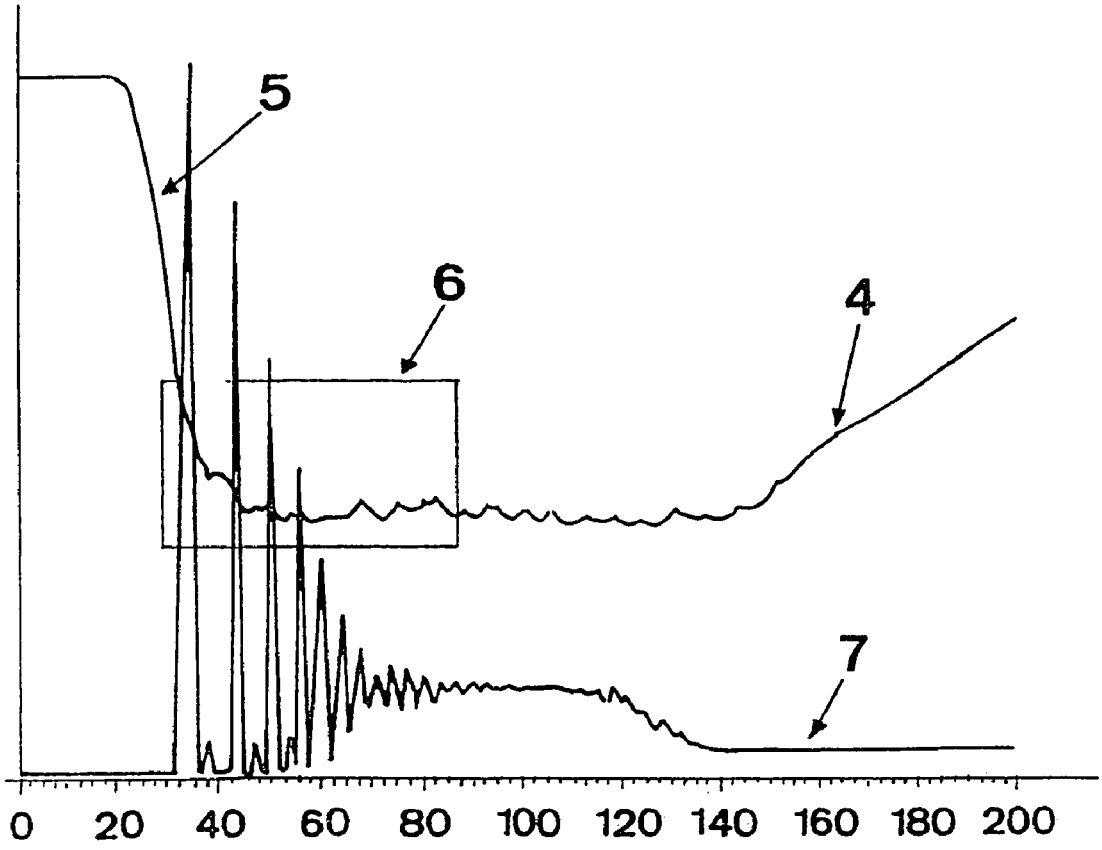
FIG. 5 is a diagram showing, in an experiment with powder compacting, both the motion of the stamping member in time and the force with which the stamping member influences the powder material during the course of compacting.

In FIG. 5 the abscissa denotes the time (milliseconds) while the ordinate denotes the motion distance of the stamping member with reference to the graph indicated with 4 while the ordinate refers to force concerning the graph indicated with 7. As previously mentioned, the stamping member describes a rebound motion during a forming step. In the diagram according to FIG. 5 the graph 4 shows the motion of the stamping member at the performed experiment with powder compacting. The graph 7 describes the force with which the stamping member influences the powder material being compacted.

From the diagram in FIG. 5 it can be seen, with reference to the compacting phase indicated with 6, how the force (the graph 7) in the powder material increases at every rebound of the stamping member, see the graph 4. Further it is evident how the stamping member takes an increasingly lower position after every rebound, see the graph 4, and thereby gives the powder material an increasingly higher degree of compacting. After the motion of the stamping member has subsided, the stamping member sooner or later is manoeuvred up to the parking position according to graph 4. The force according to the graph 7 does not decrease to its original position due to inner friction in the compacting tool itself.

Figure 6:
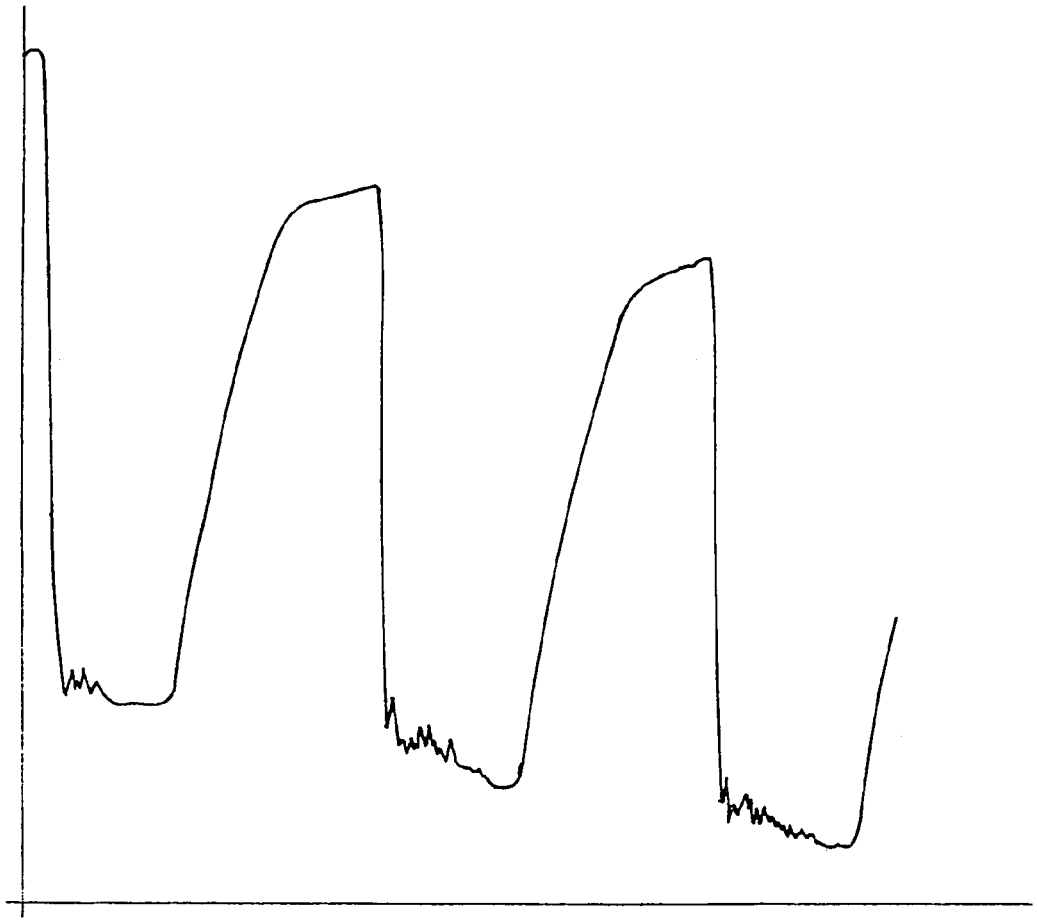
FIG. 6 is a diagram describing the position of the stamping member as function of time at deformation (forming) of a solid body.
Figure 7:
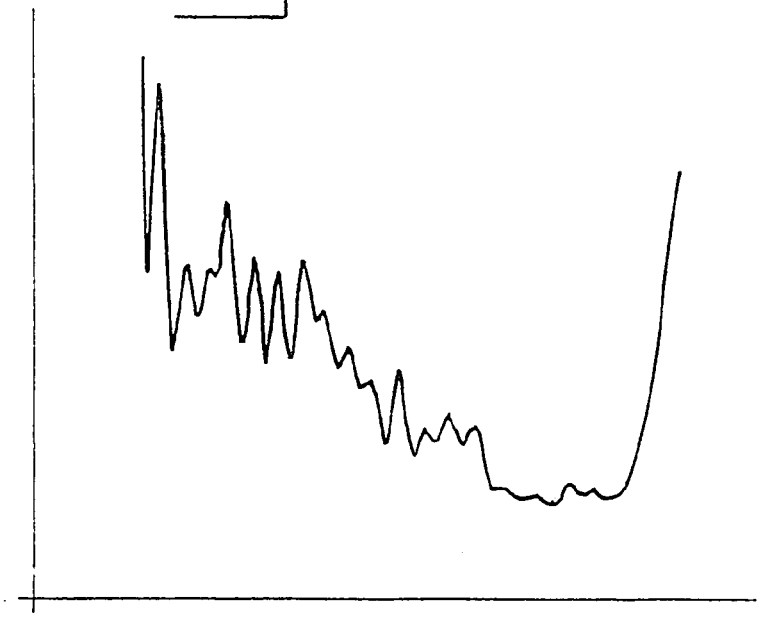
FIG. 7 is an enlargement of the third forming step evident from FIG. 6.

In FIG. 6 forming of a solid body with a striking sequence including three strokes is illustrated. In FIG. 6 the abscissa indicates the time while the ordinate indicates the motion distance of the stamping member. Consequently, from FIG. 6 the position of the stamping member as function of the time can be gathered, acceleration phase, forming phase and upward motion of the stamping being evident for each of the three strokes. In FIG. 7, an enlargement of the third forming step (stroke) is illustrated.

The device according to the invention is preferably a striking machine of a type similar to the one described in the previous patent application WO 97/00751 of the applicant. Such a striking machine uses preferably hydraulics to generate the strokes or impacts achieved by means of a stamping member 2 against a material body 1. The device is preferably arranged so that it can perform several consecutive series of impacts of the kind according to the invention with very short mutual time space between the series, respectively.

The invention proposes a very effective and reliable way, in which material bodies, solid as well as more loosely put together from single particles, can be deformed and/or compacted. The energy that a stamping or striking member exhibits when it hits the material body which is to be deformed is used in the best possible way in order to generate as large a deformation as possible in the material body. In addition, the presence of unwanted structures in the deformed material body, arising at large temperature variations in it, are reduced compared to when single strokes or stroke series according to prior art is used to achieve a deformation of it through adiabatic coalescence in the material body.

Of course a plurality of alternative embodiments, lying within the scope of the invention, will be obvious for a man skilled in the art. The idea of the invention shall be interpreted in its widest sense and as defined in the enclosed patent claims with support of the description and the enclosed drawings.

What is claimed is:

1. A method for adiabatic deformation of a material body (1), comprising the steps of conveying a stamping member (2) towards the material body (1) such that the stamping member (2) impacts (F) the material body (1) with such velocity to generate adiabatic coalescence causing permanent deformation of the material body (1) and generating a rebound motion of the stamping member (2), and counteracting (3) the rebound motion of the stamping member (2) and generating at least one additional impact of the stamping member (2) against the material body (1), within a period during which kinetic energy of a reciprocating wave in the material body (1), generated in connection with the rebound motion of the stamping member (2), generates additional deformation in the material body (1) by gradual activation of sliding planes or mutual displacement of powder grains in the material body (1).

2. The method of claim 1, comprising the step of counteracting (3) the rebound motion by causing a force (F1) to act upon the stamping member (2) in a direction towards the material body (1).

3. The method of claim 2, comprising the step of causing the stamping member (2) to impact the material body (1) in the direction towards the material body (1) such that the force (F1) acting upon the stamping member (2) comprises, at least in part, gravity acting upon the stamping member (2).

4. The method of claim 1, comprising the step of applying (3) a force (F1) to the stamping member (2) in the direction towards the material body (1) to counteract the rebound motion of the stamping member (2).

5. The method of claim 1, comprising the step of generating a series of impacts of the stamping member (2) against the material body (1) within said period.

6. The method of claim 5, comprising the step of counteracting a corresponding series of rebounds of the stamping member (2).

7. The method of claim 5, comprising the step of decreasing impulse with which the stamping member (2) impacts the material body (1) with each succeeding impact in said series.

8. The method of claim 5, comprising the step of after completing the series of impacts, applying at least one additional series of impacts to the material body (1).

9. The method of claim 1, comprising the step of causing the stamping member (2) to accelerate towards the material body (1) under influence of gravity.

10. The method of claim 1, wherein the period is approximately 1 ms.

11. The method of claim 8, wherein the series of impacts is completed after reciprocating waves generated in the material body (1) at a moment the stamping member (2) bounces back from the material body (1), have subsided.

12. The method of claim 1, wherein the material body (1) is a solid body comprising metal material, and the kinetic energy of the reciprocating wave generates gradual activation of sliding planes in the material body (1).

13. The method of claim 1, wherein the material body (1) a powder provided in a mold, and the kinetic energy of the reciprocating wave generates gradual mutual displacement of powder grains in the material body (1).

14. A device for deformation of a material body (1), comprising means for receiving the material body (1) to be deformed, a stamping member (2) structured and arranged to impact the material body (1) with velocity such that adiabatic coalescence causing permanent deformation of the material body is produced in the material body (1) while a rebound motion of the stamping member (2) is generated, and means (3) structured and arranging for generating a force (F1) upon the stamping member (2) in a direction of the material body (1) and counteracting the rebound of the stamping member (2) and generating at least one additional impact of the stamping member (2) against the material body (1) within a period during which kinetic energy of a reciprocating wave in the material body (1), generated in connection with the rebound motion of the stamping member (2), generates additional deformation in the material body (1) by gradual activation of sliding planes or a mutual displacement of powder grains in the material body (1).

15. The device of claim 14 wherein said means (3) is an hydraulic cylinder.

16. The device of claim 14, wherein said stamping member (2) and means (3) are structured and arranged with respect to one another such that succeeding impacts upon the material body (1) during a series of rebounds of the stamping member (2) gradually decrease.

17. The device of claim 14, wherein the period is approximately 1 ms.

* * * * *